US008573547B2

(12) United States Patent
Hazzard et al.

(10) Patent No.: US 8,573,547 B2
(45) Date of Patent: Nov. 5, 2013

(54) READY TO ASSEMBLE CHAIR BASE

(75) Inventors: Thomas B. Hazzard, Ladera Ranch, CA (US); Tracy Leigh Hazzard, Ladera Ranch, CA (US)

(73) Assignee: Whalen Furniture Manufacturing, Inc., San Diego, CA (US)

( * ) Notice: Subject to any disclaimer, the term of this patent is extended or adjusted under 35 U.S.C. 154(b) by 92 days.

(21) Appl. No.: 13/446,812

(22) Filed: Apr. 13, 2012

(65) Prior Publication Data

US 2012/0261532 A1 Oct. 18, 2012

Related U.S. Application Data

(60) Provisional application No. 61/475,984, filed on Apr. 15, 2011.

(51) Int. Cl.
*A47B 91/00* (2006.01)

(52) U.S. Cl.
USPC ..... 248/188.7; 248/345.1; 403/334

(58) Field of Classification Search
USPC ..... 248/188.7, 188.1, 188.8, 176.1, 125.1, 248/121, 345.1; 403/334; 297/463.1, 297/452.18, 440.2, 411.2, 411.24, 411.46
See application file for complete search history.

(56) References Cited

U.S. PATENT DOCUMENTS

| | | | | |
|---|---|---|---|---|
| 1,574,963 | A | 3/1926 | Foote | |
| 1,717,142 | A | 6/1929 | Bump | |
| 2,720,252 | A | 10/1955 | Turnell | |
| 5,048,780 | A | 9/1991 | Borsani | |
| 5,377,943 | A | 1/1995 | Perl | |
| 5,402,973 | A * | 4/1995 | Haines | 248/188.7 |
| 5,906,343 | A | 5/1999 | Battey et al. | |
| 5,938,156 | A | 8/1999 | Kao | |
| 5,964,436 | A | 10/1999 | Battey et al. | |
| 6,290,191 | B1 | 9/2001 | Hendricks et al. | |
| 6,386,491 | B1 * | 5/2002 | Bissett | 248/121 |
| D470,691 | S | 2/2003 | Chen | |
| 7,032,869 | B2 * | 4/2006 | Edwards et al. | 248/188.7 |
| 7,144,084 | B2 | 12/2006 | Edwards et al. | |
| 7,314,252 | B2 | 1/2008 | Ohliv et al. | |
| 2009/0236479 | A1 * | 9/2009 | Rose | 248/188.7 |

FOREIGN PATENT DOCUMENTS

EP 0345758 B1 12/1989

OTHER PUBLICATIONS

Avenue Six "Yield" Swivel Chair Assembly Instructions.

* cited by examiner

*Primary Examiner* — Todd M. Epps
(74) *Attorney, Agent, or Firm* — Barlow, Josephs & Holmes, Ltd.

(57) ABSTRACT

A ready to assemble chair base includes three leg components. First and second leg components each include two of the five legs, and a third leg component includes a single leg. A hub portion of all three components includes a portion of the central tapered hole. The hub portions of the first and second components join together with vertical interlocking surfaces slidably locking together in the direction of the axis of the central tapered hole. The hub of the third leg component is formed in the shape of a tenon blade and is inserted into a horizontal mortise slot (perpendicular to the axis of the central hole) formed by the interlocked hubs of the first and second leg components. A gas lift post is received into the center, tapered hole of the assembled base locking all three components together.

19 Claims, 11 Drawing Sheets

READY TO ASSEMBLE CHAIR BASE

BACKGROUND AND SUMMARY OF THE INVENTION

The present invention relates to ready to assemble furniture, and more particularly to a ready to assembly chair base for a rolling office chair.

Rolling office chairs are known to include a large diameter chair base having 5 or more legs radiating out from a central hub. The multiple legs and large diameter provides stability for a chair that is able to roll about as well as recline. While the large diameter chair base is critical to stability of the chair, it has the drawback of significantly increasing shipping costs because the diameter of the chair base is the largest dimension of the chair, and thus dictates the size of the packaging of the chair for shipping. A larger box reduces the number of boxes that can fit into a shipping container and increases the overall landed costs of the chair when shipped.

In order to reduce shipping costs, many such chairs are broken down into smaller subassemblies for shipping. For example, the chair base, post (gas lift), seat and seat back are disassembled and packed into a smaller box. This significantly reduces the size of the shipping box and the landed cost. However, the diameter of the chair base is still the largest dimension of the box contents and still dictates the largest single dimension of the box. Because it is an ongoing objective of manufacturers to continually reduce landed cost of products, there is a continuing need in the industry to reduce the size of packaging, and in this case, packaging for rolling office chairs.

The present invention provides a unique and novel ready to assembly chair base, which can be broken down into several component parts, packed in a smaller volume of space, and then easily re-assembled by the consumer.

In an exemplary embodiment, the chair base comes apart into 3 components. First and second leg components each include 2 of the 5 legs, and a third leg component includes only a single leg. A hub portion of all three components includes a portion of the central tapered hole. The hub portions of the first and second components join together with vertical interlocking surfaces, i.e. they slidably lock together in the direction of the axis of the central tapered hole. The hub of the third leg component (single leg) is formed in the shape of a blade and is inserted into a horizontal slot (perpendicular to the axis of the central hole) formed by the interlocked hubs of the first and second leg components. The slot and blade use a butterfly joint to hold all three components together. Once the gas lift is inserted into the center, tapered hole of the base it locks all three components together.

In one version of the exemplary embodiment, the interlocking surfaces are tapered dovetail joints, and in a second version, the interlocking surfaces are T-shaped joints.

Among the objects of the instant invention is the provision of a ready to assemble chair base that can be broken down into several component parts and packed into a smaller volume of space than the assembled components.

Another object of the instant invention is the provision of a ready to assemble chair base that be easily reassembled by the consumer with no tools.

Other objects, features and advantages of the invention shall become apparent as the description thereof proceeds when considered in connection with the accompanying illustrative drawings.

BRIEF DESCRIPTION OF THE DRAWING FIGURES

In the drawings which illustrate the best mode presently contemplated for carrying out the present invention:

DETAILED DESCRIPTION OF AN EXEMPLARY EMBODIMENT

Figure 1:
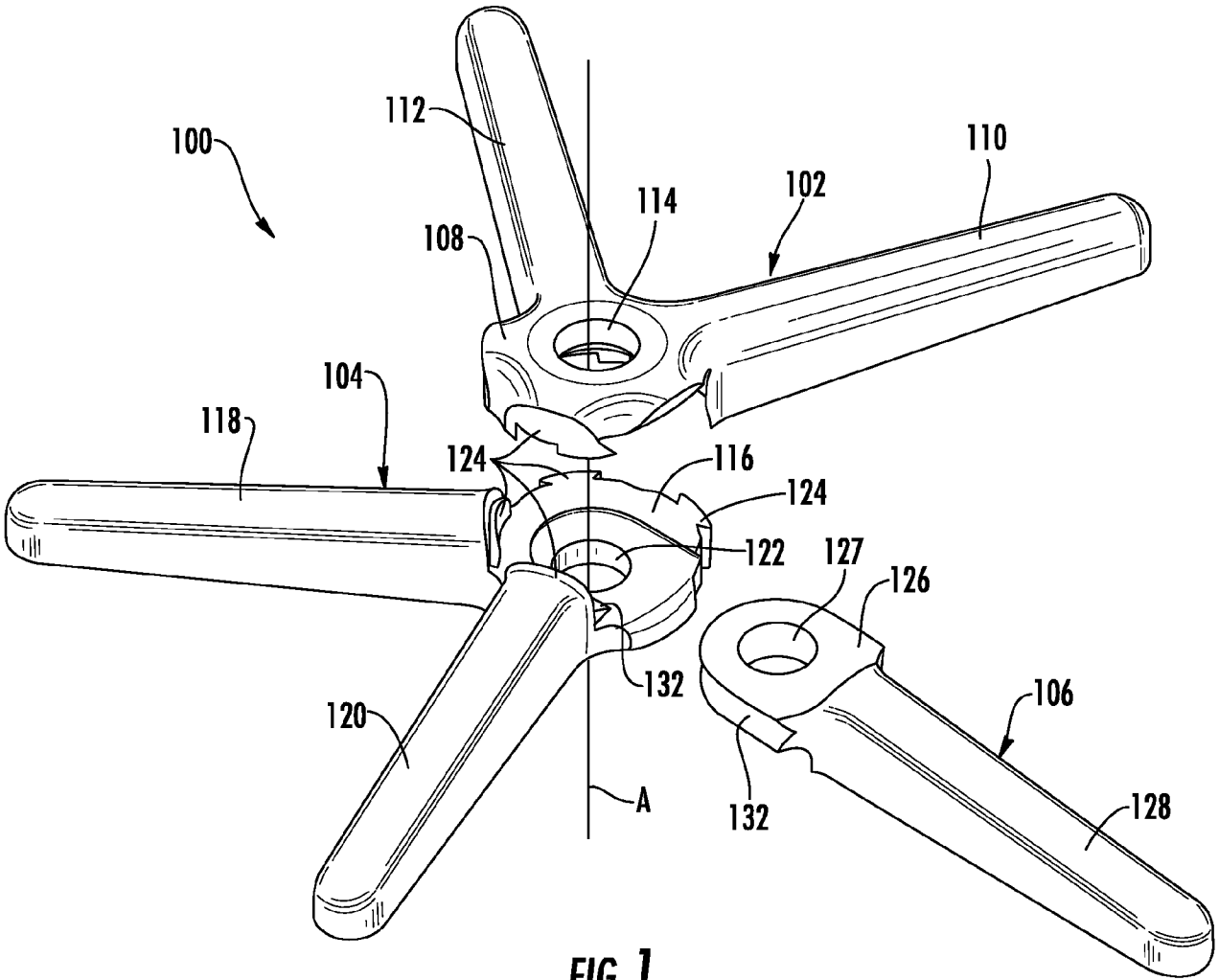
FIG. 1 is an exploded perspective view of an exemplary embodiment of the ready to assemble chair base constructed in accordance with the teachings of the present invention.
Figure 2:
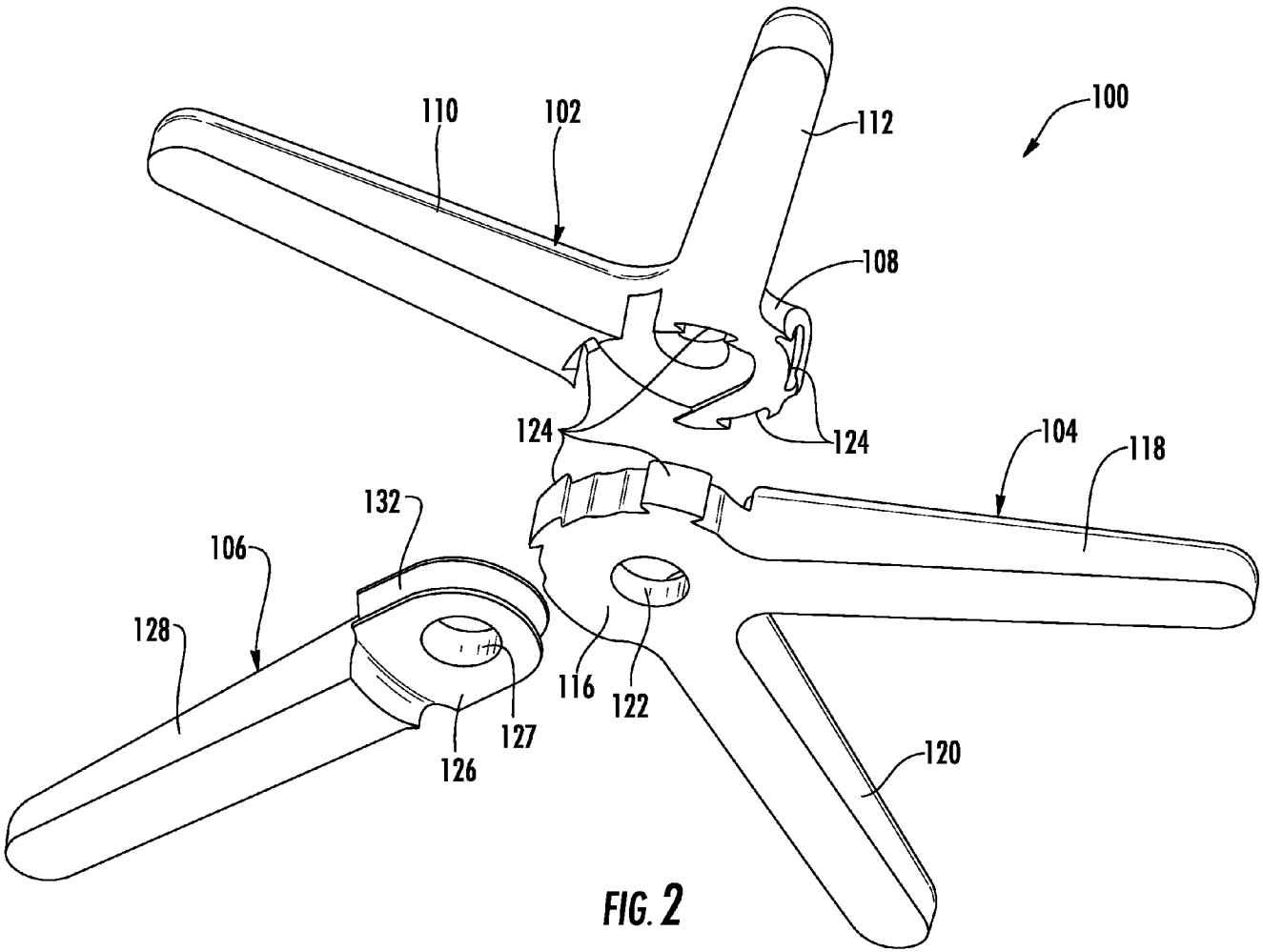
FIG. 2 is another exploded perspective view thereof.
Figure 3:
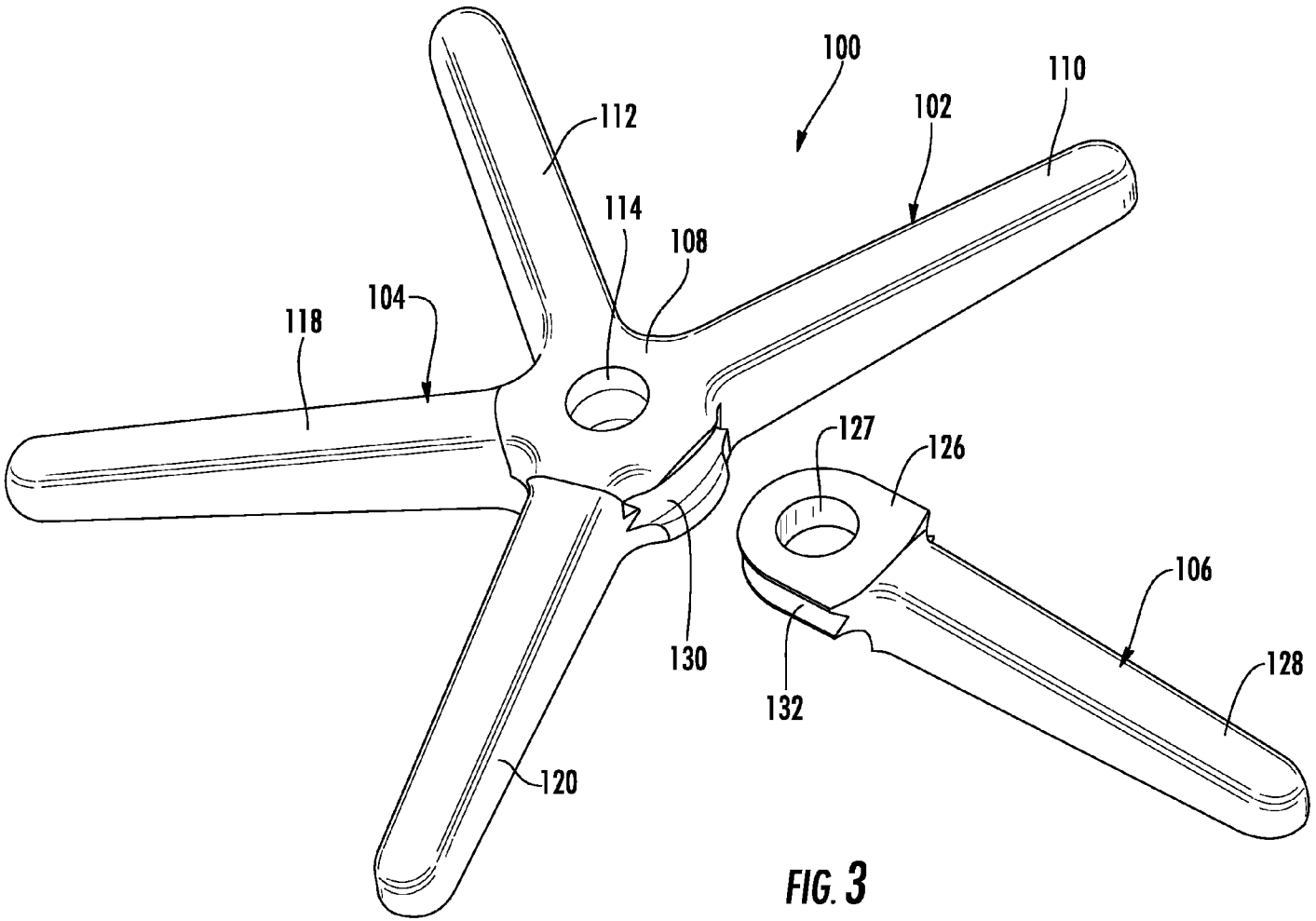
FIG. 3 is a partially assembled view thereof.
Figure 4:
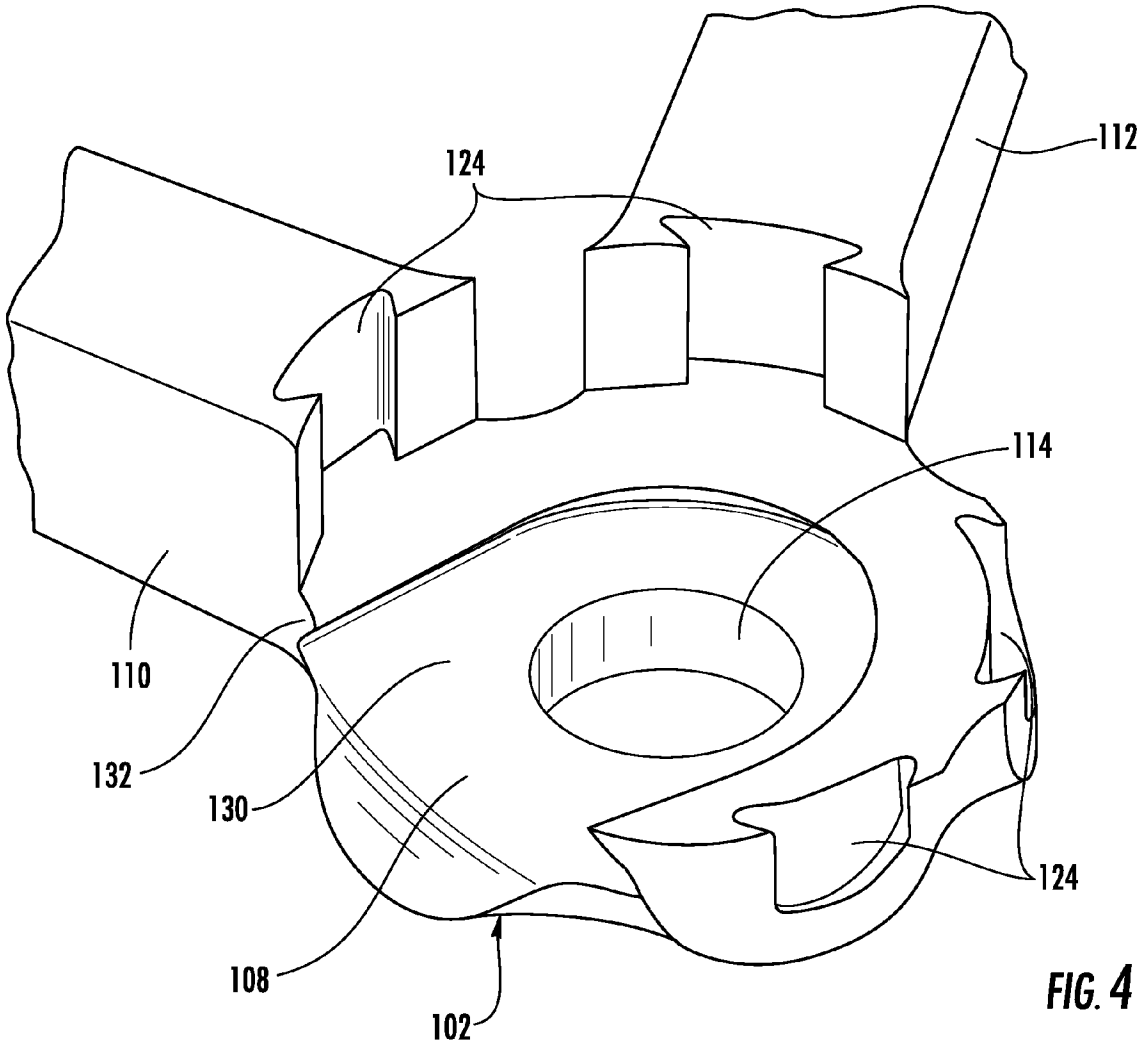
FIG. 4 is an enlarged perspective view showing the underside of the hub of the first (upper) leg component.
Figure 5:
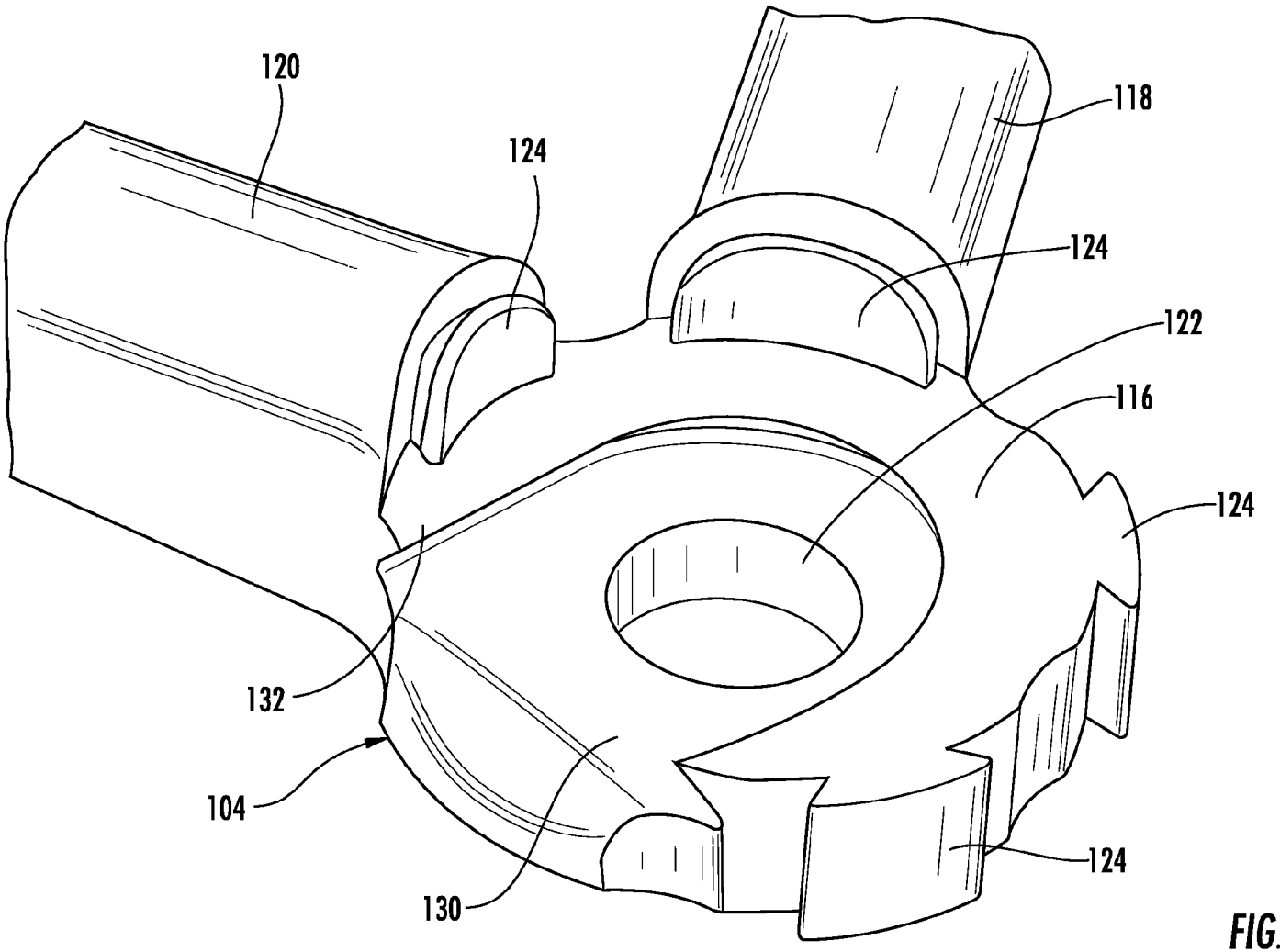
FIG. 5 is an enlarged perspective view showing the hub of the second (lower) leg component.
Figure 6:
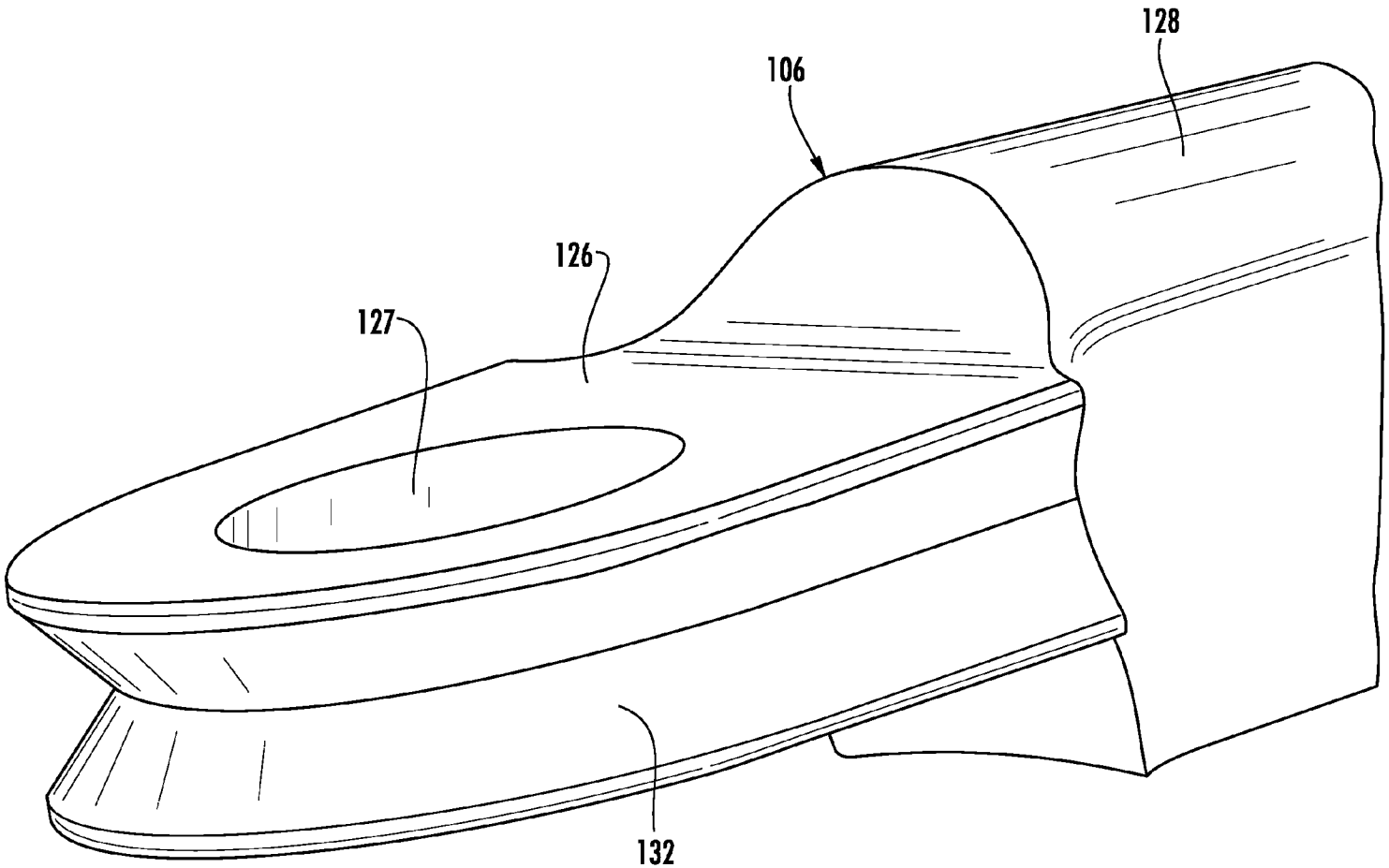
FIG. 6 is an enlarged perspective view showing the hub of the third leg component.

Referring now to the drawings, an exemplary embodiment of the ready to assembly chair base is illustrated and generally indicated at 100 in FIGS. 1-6. As seen in FIG. 1, a five leg chair base comes apart into three components, 102, 104 and 106. First and second leg components 102 and 104 each include two of the five legs, and a third leg component 106 includes only a single leg. While a chair base with five legs is illustrated it should be understood that the underlying concepts can be applied to a chair base with other numbers of legs with equal result.

The first leg component 102 (upper part) has a central hub portion 108 and two legs 110, 112 extending radially outward from the hub 108. The central hub portion 108 includes a central, downwardly tapered, frustoconical hole 114 aligned along a vertically extending hub axis A (see FIG. 1). For purposes of the present disclosure, downwardly tapered simply means that the diameter at the top of the hole is larger than the diameter at the bottom.

The second leg component 104 (lower part) has a central hub portion 116 and two legs 118, 120 extending radially outward form the hub 116. The central hub portion 116 includes a central, downwardly tapered, frustoconical hole 122, also extending along said hub axis.

The hub portions 108, 116 of the first and second components 102, 104 join together with vertically extending, mating interlocking structures 124 that slidably lock together in the direction of (parallel to) the axis A of the central tapered hole 114, 122 (see FIGS. 1-5). In this first exemplary embodiment, the interlocking structures 124 comprise interlocking dovetail structures. As illustrated, the lower component 104 includes the male dovetail structures, while the upper component 102 includes the female dovetail structures. However, it should be understood that these structures 124 could be reversed in one or more locations with the same result.

The third leg component 106 (middle part) has a central hub portion 126 and a single leg 128 extending radially outward. The central hub portion 126 includes a central, downwardly tapered, frustoconical hole 127, also extending along said hub axis.

The hub portion 126 of the third leg component 106 (single leg) is formed in the shape of a tenon blade and is slidably received into a horizontal mortise slot 130 (FIG. 3) cooperatively formed by the interlocked hubs 108, 116 of the first and second leg components 102, 104. The mortise slot 130 and tenon blade 126 employ butterfly joint structures 132 that interlock the three components 102, 104, 106 together.

When assembled, the hub portions 108, 116, 126 of all three components 102, 104, 106 cooperate to form a continuously tapered frustoconical hole, which will accept a gas lift (not shown) as is known in the art. Once the gas lift is inserted into the hole of the base 100, it locks all three components 102, 104, 106 together.

A second version of the chair base is illustrated and indicated at 200 in FIGS. 7-11. The second version of the chair base 200 includes all of the same components as the first version, with the exception being that the interlocking mating structures are T-shaped rather than dovetail shaped. Like components are indicated with a 200 series reference number.

Figure 7:
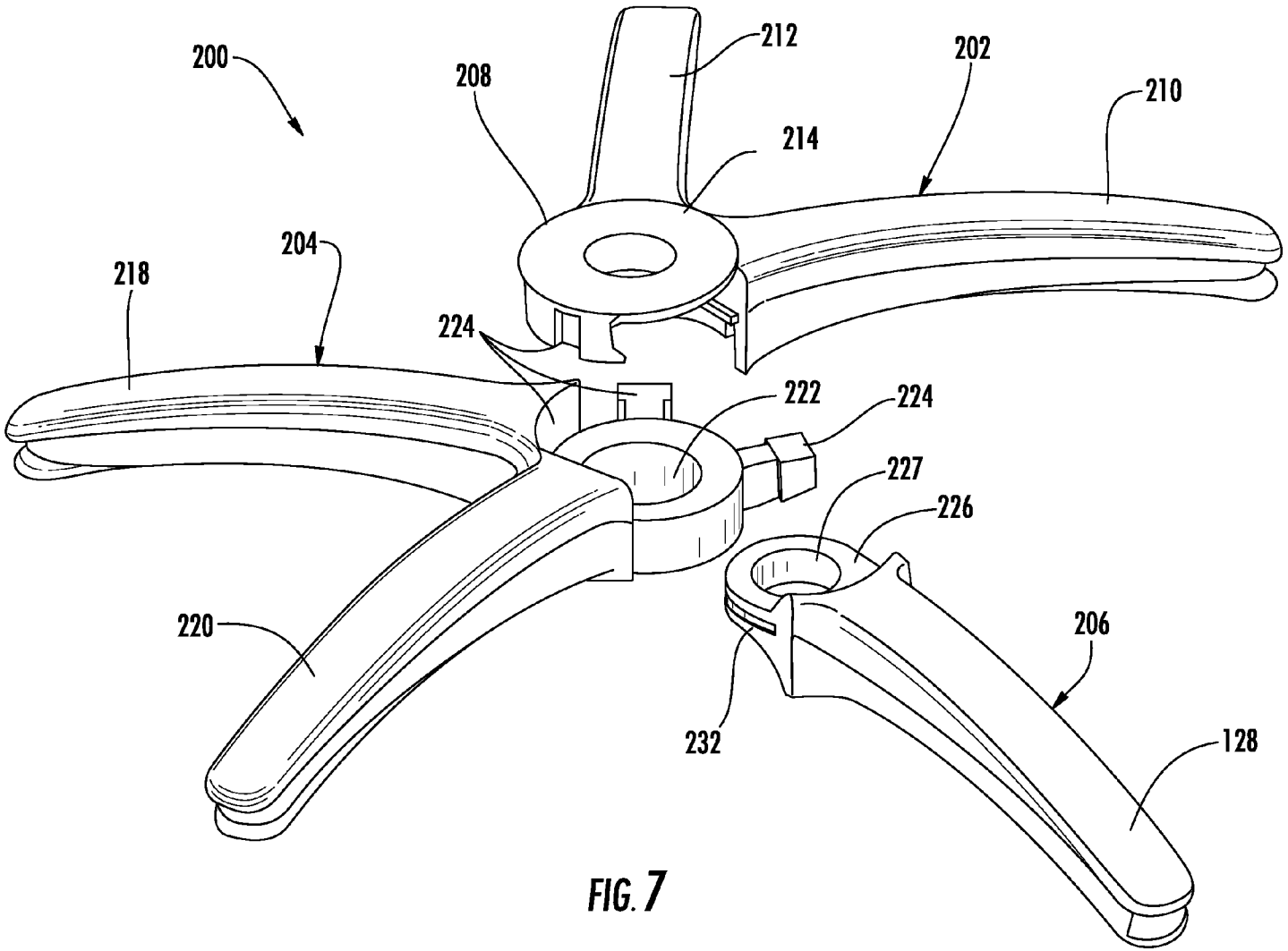
FIG. 7 is an exploded perspective view of another exemplary embodiment of the ready to assemble chair base constructed in accordance with the teachings of the present invention.

As seen in FIG. 7, the five leg chair base comes apart into three components, 202, 204 and 206. First and second leg components 202 and 204 each include two of the five legs, and a third leg component 206 includes only a single leg.

The first leg component 202 (upper part) has a central hub portion 208 and two legs 210, 212 extending radially outward from the hub 208. The central hub portion 208 includes a central, downwardly tapered, frustoconical hole 214 aligned along a vertically extending hub axis A.

The second leg component 204 (lower part) has a central hub portion 216 and two legs 218, 220 extending radially outward form the hub 216. The central hub portion 216 includes a central, downwardly tapered, frustoconical hole 222, also extending along said hub axis.

Figure 8:
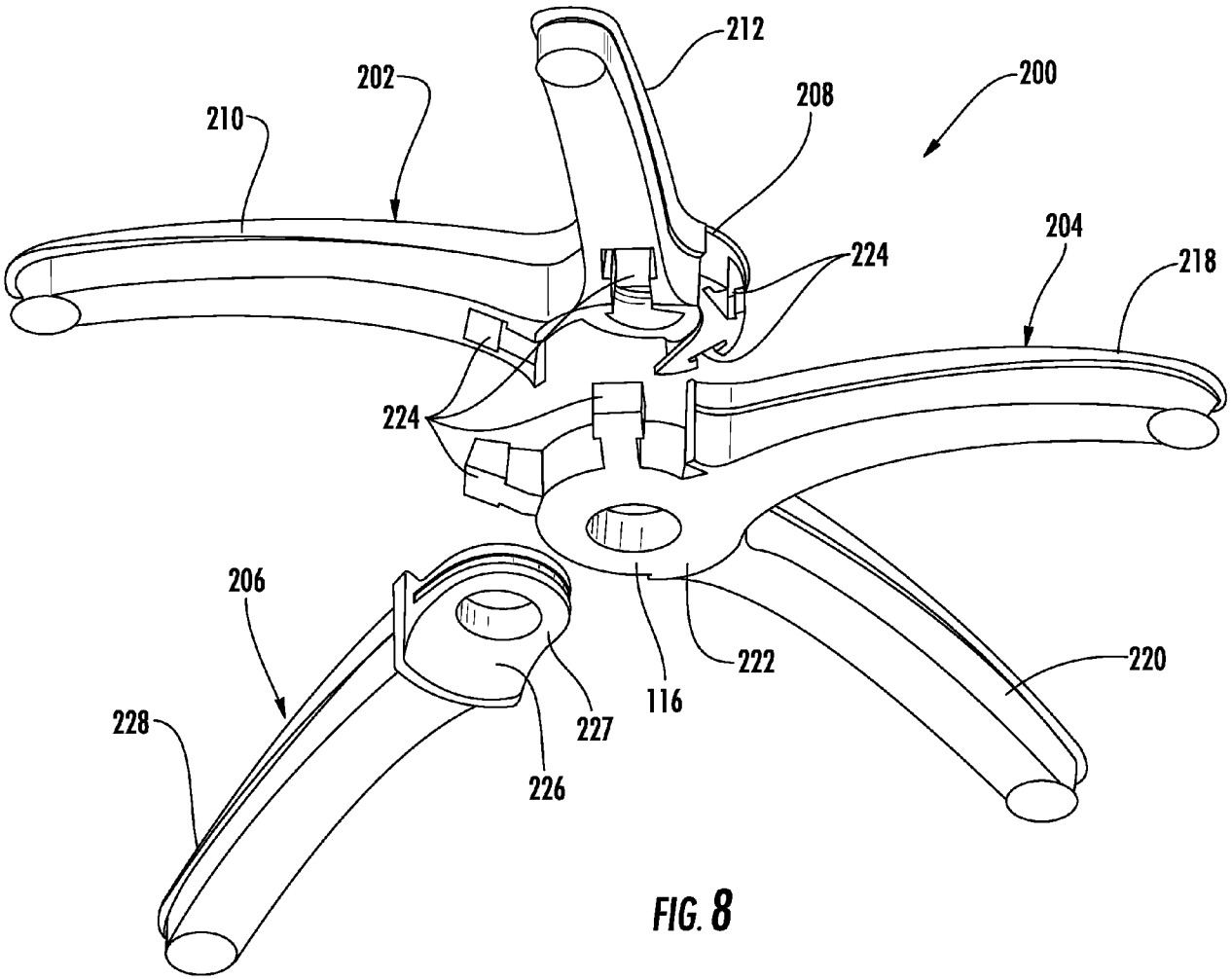
FIG. 8 is another exploded perspective view thereof.
Figure 9:
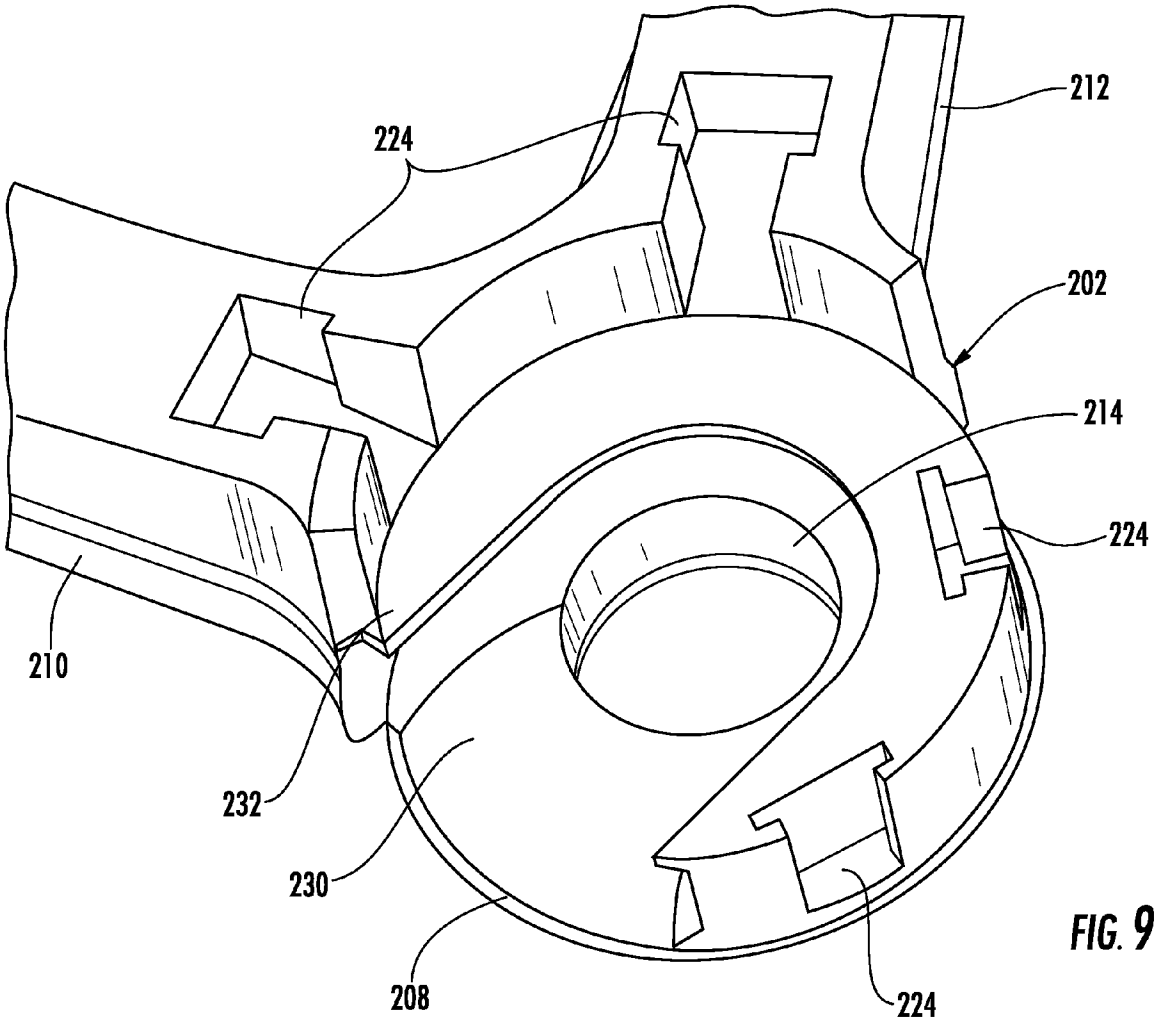
FIG. 9 is an enlarged perspective view showing the underside of the hub of the first (upper) leg component.
Figure 10:
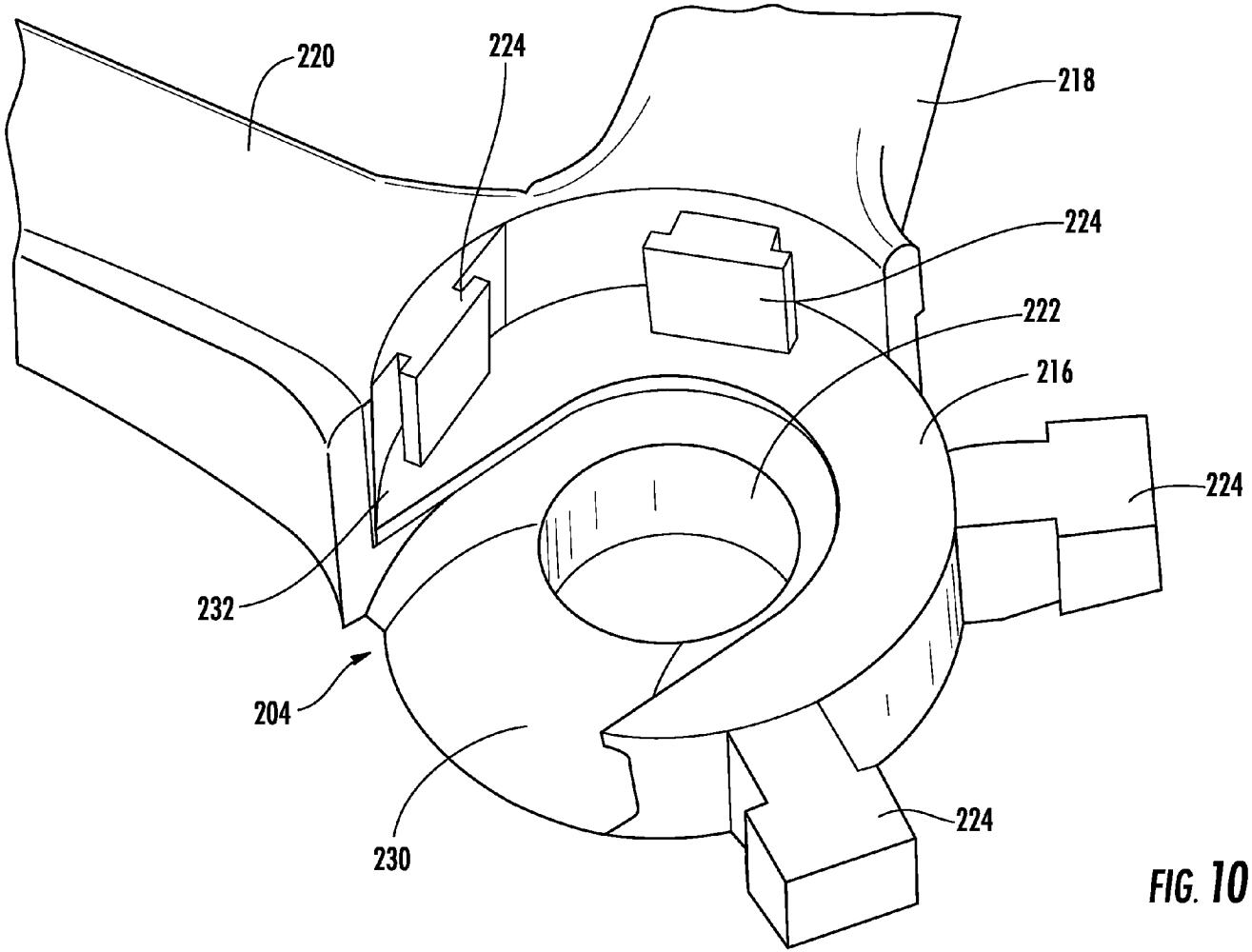
FIG. 10 is an enlarged perspective view showing the hub of the second (lower) leg component.
Figure 11:
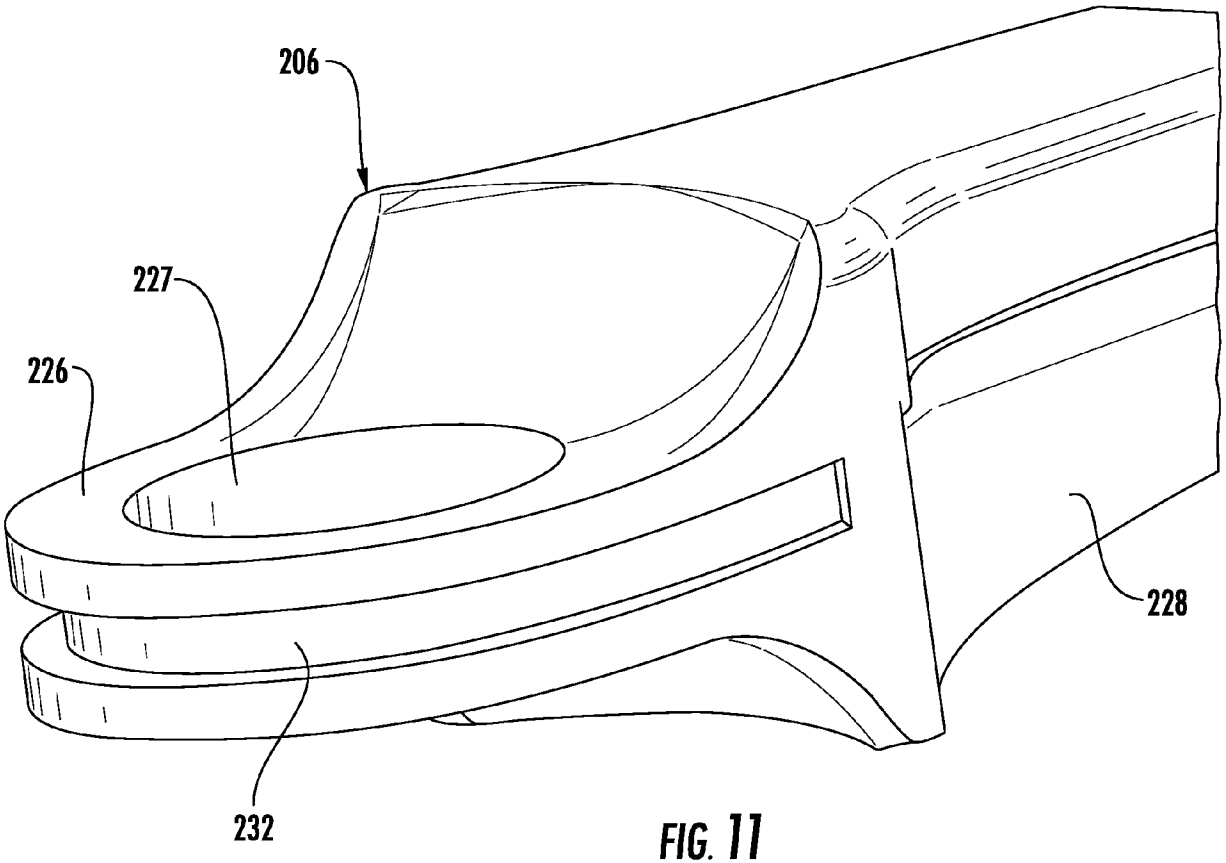
FIG. 11 is an enlarged perspective view showing the hub of the third leg component.

The hub portions 208, 216 of the first and second components 202, 204 join together with vertically extending, mating interlocking structures 224 that slidably lock together in the direction of (parallel to) the axis A of the central tapered hole 214, 222 (see FIGS. 7-8). In this second exemplary embodiment, the interlocking structures 224 comprise interlocking T-shaped structures. As illustrated, the lower component 204 includes the male T-shaped structures, while the upper component 202 includes the female T-shaped structures. However, it should be understood that these structures 224 could be reversed in one or more locations with the same result.

The third leg component 206 (middle part) has a central hub portion 226 and a single leg 228 extending radially outward. The central hub portion 226 includes a central, downwardly tapered, frustoconical hole 227, also extending along said hub axis.

The hub portion 226 of the third leg component 206 (single leg) is formed in the shape of a tenon blade and is slidably received into a horizontal mortise slot 230 cooperatively formed by the interlocked hubs 208, 216 of the first and second leg components 202, 204. The mortise slot 230 and tenon blade 226 employ shoulder and groove joint structures 232 that interlock the three components 202, 204, 206 together.

For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claim.

What is claimed is:

1. A ready to assemble chair base comprising:

an upper leg component having a hub and at least one leg extending radially outward from said hub, said hub of said upper leg component having a hub axis and an aperture extending therethrough along said hub axis;

a lower leg component having a hub and at least one leg extending radially outward from said hub, said hub of said lower leg component having an aperture extending therethrough along said hub axis, said hubs of said upper and lower leg components including mating interlocking structures which slidably interlock in a direction parallel to said hub axis, said hubs of said upper and lower leg components cooperating to form a mortise slot extending radially inwardly in a direction perpendicular to said hub axis;

a middle leg component having a hub and at least one leg extending radially outward from said hub, said hub of said middle leg component having an aperture extending therethrough along said hub axis, said hub of said middle leg component comprising a tenon blade which is slidably received into said mortise slot formed by said upper and lower leg components.

2. The ready to assemble chair base of claim 1, wherein said interlocking mating structures of said first and second hubs comprise dovetail joint structures.

3. The ready to assemble chair base of claim 2, wherein said hub of said lower leg component includes male dovetail structures and said upper leg component includes female dovetail structures.

4. The ready to assemble chair base of claim 1, wherein said tenon blade of said third leg component and said mortise slot formed by said upper and lower leg components comprise butterfly joint structures.

5. The ready to assemble chair base of claim 2, wherein said tenon blade of said third leg component and said mortise slot formed by said upper and lower leg components comprise butterfly joint structures.

6. The ready to assemble chair base of claim 3, wherein said tenon blade of said third leg component and said mortise slot formed by said upper and lower leg components comprise butterfly joint structures.

7. The ready to assemble chair base of claim 1, wherein said interlocking mating structures of said first and second hubs comprise T-shaped joint structures.

8. The ready to assemble chair base of claim 7, wherein said hub of said lower leg component includes male T-shaped structures and said upper leg component includes female T-shaped structures.

9. The ready to assemble chair base of claim 1, wherein said tenon blade of said third leg component and said mortise slot formed by said upper and lower leg components comprise shoulder and groove joint structures.

10. The ready to assemble chair base of claim 8, wherein said tenon blade of said third leg component and said mortise slot formed by said upper and lower leg components comprise shoulder and groove joint structures.

11. The ready to assemble chair base of claim 9, wherein said tenon blade of said third leg component and said mortise slot formed by said upper and lower leg components comprise shoulder and groove joint structures.

12. The ready to assemble chair base of claim 1, wherein said first and second leg components each include two legs, and said third leg component includes a single leg.

13. The ready to assemble chair base of claim 6, wherein said first and second leg components each include two legs, and said third leg component includes a single leg.

14. The ready to assemble chair base of claim 7, wherein said first and second leg components each include two legs, and said third leg component includes a single leg.

15. The ready to assemble chair base of claim 11, wherein said first and second leg components each include two legs, and said third leg component includes a single leg.

16. The ready to assemble chair base of claim 1, wherein said apertures in said hubs are downwardly tapered to receive a tapered chair post.

17. The ready to assemble chair base of claim 6, wherein said apertures in said hubs are downwardly tapered to receive a tapered chair post.

18. The ready to assemble chair base of claim 7, wherein said apertures in said hubs are downwardly tapered to receive a tapered chair post.

19. The ready to assemble chair base of claim 11, wherein said apertures in said hubs are downwardly tapered to receive a tapered chair post.

* * * * *